United States Patent [19]

Espenscheid et al.

[11] 4,052,291

[45] Oct. 4, 1977

[54] PRODUCTION OF ASPHALT CEMENT

[75] Inventors: Wilton F. Espenscheid, Princeton, N.J.; Tsoung-Yuan Yan, Philadelphia, Pa.

[73] Assignee: Mobil Oil Corporation, New York, N.Y.

[21] Appl. No.: 714,877

[22] Filed: Aug. 16, 1976

[51] Int. Cl.[2] ..... C10G 1/04

[52] U.S. Cl. ..... 208/8; 208/23; 208/39

[58] Field of Search ..... 208/8, 23, 39

[56] References Cited

U.S. PATENT DOCUMENTS

| | | | |
|---|---|---|---|
| 2,297,455 | 9/1942 | Brautigam et al. | 208/23 |
| 2,304,773 | 12/1942 | Anderton | 208/23 |
| 3,642,608 | 2/1972 | Roach et al. | 208/8 |

*Primary Examiner*—Herbert Levine

*Attorney, Agent, or Firm*—Charles A. Huggett; Carl D. Farnsworth

[57] ABSTRACT

This invention provides a novel asphalt cement which is produced by solubilizing solvent-refined coal in a thermally stable refinery petroleum solvent.

2 Claims, No Drawings

PRODUCTION OF ASPHALT CEMENT

BACKGROUND OF THE INVENTION

Asphalt cement is an important large volume commodity which is generally derived from petroleum refinery streams such as vacuum residua.

Air-blownig is normally required to increase the viscosity and lower the penetration number of the asphaltic material. During the air-blowing process, thermal and oxidative polymerization is effected, and the lower molecular weight resins are converted to asphaltenes.

Recent international economic developments have signaled the inevitable decline of petroleum as the world's supreme industrial commodity. The price of raw petroleum has increased several fold. Also, the consumption of petroleum has been increasing exponentially, and concomitantly the world petroleum supply has diminished to less than several decades of proven reserves.

The economics of upgrading petroleum refining residua into asphalt cement and other high value products is of increasing concern. Attention is being directed to coal-derived liquids as a potential abundant source of asphaltenes.

It was recognized by early workers that coal can be liquified by controlled heating in the substantial absence of oxygen. The conversion products are a liquid and a char. Because of the new compelling economic factors, the technology of coal liquefaction and gasification has been expanding at an accelerated pace. Pioneer developments in the field are represented by Lurgi and Fischer-Tropsch technology. More recent advances in coal liquefaction are described in United States Patents Nos. 1,904,586; 1,955,041; 1,996,009; 2,091,354; 2,174,184; 2,714,086; 3,375,188; 3,379,638; 3,607,718; 3,640,816; 3,642,608; 3,705,092; 3,849,287; 3,870,621; inter alia.

It is one view that liquefaction of coal proceeds via an asphaltene complex intermediate:

$$\text{coal} \rightleftarrows \text{asphaltene} \rightleftarrows \text{oil}$$

The prospective advantages of combining coal-derived materials with petroleum-derived materials have not been realized because of the general incompatibility of the two different categories of carbonaceous minerals.

Hence, there remains a pressing need for new technology to alleviate the dependence of industrial nations on petrioleum as a critical raw material in energy and chemical applications, and a need for new technology to enhance the efficient conversion of petroleum refinery residua into valuable industrial products.

Accordingly, it is an object of the present invention to improve the economics of upgrading low value refractory petroleum residua into important industrial commodities.

It is another object of the present invention to provide a method for producing homogeneous blends of coal-derived and petroleum-derived materials.

It is a further object of the present invention to provide a novel asphalt cement produced from coal-derived carbonaceous material.

Other objects and advantages of the present invention shall become apparent from the accompanying description and examples.

DESCRIPTION OF THE INVENTION

One or more objects of the present invention are accomplished by the provision of a process for producing asphalt cement which comprises forming a slurry by admixing solvent-refined coal with a petroleum solvent selected from thermally stable refinery petroleum fractions having a boiling point in the range between about 450° F and 1100° F and heating said slurry at a temperature between about 350° F and 850° F for a period of time sufficient to convert the slurry into a homogeneous composition which has a flowable asphalt consistency at standard temperature.

By the term "thermally stable" refinery petroleum fraction is meant a high boiling residuum such as fluidized catalytic cracking main column (FCC) bottoms or thermofor catalytic cracking syntower (TCC) bottoms which contain a substantial proportion of polycyclic aromatic hydrocarbon constituents such as napthalene, dimethylnaphthalene, anthracene, phenathrene, fluorene, chrysene, pyrene, perylene, diphenyl, benzothiophene, and the like. Such refractory petroleum media are resistant to conversion to lower molecular products by conventional non-hydrogenative procedures. Typically, these petroleum refinery residua and recycle fractions are hydrocarbonaceous mixtures having an average carbon to hydrogen ratio above 1:1, and a boiling point above about 450° F.

The petroleum solvents suitable for the practice of the present invention process are thermally stable, highly polycyclic aromatic mixtures which result from one or more petroleum refining operations. Representative heavy petroleum solvents include FCC main column bottoms, TCC syntower bottoms, asphaltic material, propane-deasphalted tar, coker gas oil, heavy cycle oil, clarified slurry oil, mixtures thereof, and the like.

The thermally stable refinery petroleum solvent employed in the process is a highly polycyclic aromatic mixture which performs as a hydrogen-donor solvating medium. Nominally it has a boiling point in the range between about 450° F and 1100° F. It is an important and preferred feature of the present invention that such solvent specifically is a slurry oil derived from fluidized catalytic cracking main column bottoms (MCB).

In a "fluidized catalytic cracking" process (or FCC) catalyst particles are used which are generally in the range of 10 to 150 microns in diameter. The commercial FCC processes include one or both of two types of cracking zones, i.e., a dilute bed (or "riser") and a fluid (or dense) bed. Useful reaction conditions in fluid catalytic cracking include temperatures above 850° F, pressures from subatmospheric to 3 atmospheres, catalyst-to-oil ratios of 1 to 30, oil contact time less than about 12 to 15 seconds in the "riser," preferably less than about 6 seconds, wherein up to 100% of the desired conversion may take place in the "riser," and a catalyst residence (or contact) time of less than 15 minutes, preferably less than 10 minutes, in the fluidized (or dense) bed.

The catalyst employed in the FCC reactor is characterized by a low sodium content and is an intimate admixture of a porous matrix material and a crystalline aluminosilicate zeolite, the cations of which consist essentially, or primarily of metal characterized by a substantial portion of rare earth metal, and a structure of rigid three-dimensional networks characterized by pores having a minimum cross-section of 4 to 15 Angstoms, preferably between 6 and 15 Angstrom units extending in three dimensions.

The crystalline aluminosilicate catalyst is intermixed with a material which dilutes and tempers the activity thereof so that currently available cracking equipment and methods may be employed. In a preferred embodiment, there are utilized materials which do more than perform a passive role in serving as a diluent, surface extender or control for the highly active zeolite catalyst component. The highly active crystalline aluminosilicate zeolite catalyst is combined with a major proportion of a catalytically active material which, in such combination, enhances the production of gasoline of higher octane values than are produced by cracking with such zeolitic catalysts alone, while concomitantly providing a composite catalyst composition which may be used at much higher space velocities than those suitable for other types of catalysts, and which composite catalyst composition also has greatly superior properties of product selectivity and steam stability.

The crystalline aluminosilicates employed in preparation of catalysts may be either natural or synthetic zeolites. Representative of particularly preferred zeolites are the faujasites, including the synthetic materials such as Zeolite X described in U.S. Pat. No. 2,882,244; Zeolite Y described in U.S. Pat. No. 3,130,007; as well as other crystalline aluminosilicate zeolites having pore openings of between 6 and 15 Angstroms. These materials are essentially the dehydrated forms of crystalline hydrous siliceous zeolites containing varying quantities of alkali metal and aluminum, with or without other metals. The alkali metal atoms, silicon, aluminum and oxygen in these zeolites are arranged in the form of an aluminosilicate salt in a definite and consistent crystalline pattern. The structure contains a large number of small cavities interconnected by a number of still smaller holes or channels. These cavities and channels are uniform in size. The alkali metal aluminosilicate used in preparation of the present catalyst has a highly ordered crystalline structure characterized by pores having openings of uniform sizes within the range greater than 4 and less than 15 Angstroms, preferably between 6 and 15 Angstroms, the pore openings being sufficiently large to admit the molecules of the hydrocarbon charge desired to be converted. The preferred crystalline aluminosilicates will have a rigid three-dimensional network characterized by a system of cavities and interconnecting ports of pore openings, the cavities being connected with each other in three dimensions by pore openings or ports which have minimum diameters of greater than 6 Angstrom units and less than 15 Angstrom units. A specific typical example of such a structure is that of the mineral faujasite.

The effluent friom the FCC reactor is subjected to a separation procedure for removal of the suspended solid catalyst. Cyclone separators are a preferred means.

The hydrocarbon phase which is obtained from this separation procedure is passed into a product fractionator, i.e., a main column distillation unit, wherein the product stream is separated into heavy oil recycle fractions, middle gasoline fractions, and light end fractions. The residual fraction is a highly automatic hydrocarbon mixture referred to as "FCC main column bottoms".

The FCC main column bottoms fraction is recovered as a slurry containing a suspension of catalyst fines. The "slurry oil" is directly suitable for use as a liquefaction solvent in the invention process, or it can be subjectedto further treatment to yield a "clarified slurry oil". The further treatment can involve introducing the hot slurry oil into a slurry settler unit in which it is contacted with cold heavy cycle oil to facilitate settling of catalyst fines out of the slurry oil. The overhead liquid effluent from the slurry settler unit is the said "clarified slurry oil". A more detailed description of the production and recovery of FCC main tower bottoms is disclosed in U.S. Pat. No. 3,725,240.

A typical clarified slurry oil has the following nominal analysis and properties:

| Elemental Analysis, Wt. % | |
|---|---|
| C | 89.93 |
| H | 7.35 |
| O | 0.99 |
| N | 0.44 |
| S | 1.09 |
| Total | 99.80 |
| Pour Point, ° F: 50 | |
| CCR, %: 9.96 | |
| Distillation: | |
| IBP, ° F: | 490 |
| 5%, ° F: | 640 |
| 95%, ° F: | 905 |

A typical FCC main column bottoms contains a mixture of chemical constituents as represented in the following mass spectrometric analysis:

| Compounds | Aromatics | Naphthenic-Aromatics | Labile $H_2$ % |
|---|---|---|---|
| Alkyl-Benzenes | 0.4 | | 0 |
| Naphthene-Benzenes | | 1.0 | 0.03 |
| Dinaphthene-Benzenes | | 3.7 | 0.16 |
| Naphthalenes | 0.1 | | 0 |
| Acenaphthenes, (biphenyls) | | 7.4 | 0.08 |
| Fluorenes | | 10.1 | 0.11 |
| Phenanthrenes | 13.1 | | |
| Naphthene-phenanthrenes | | 11.0 | 0.18 |
| Pyrenes, fluoranthenes | 20.5 | | 0 |
| Chrysenes | 10.4 | | 0 |
| Benzofluoranthenes | 6.9 | | 0 |
| Perylenes | 5.2 | | 0 |
| Benzothiophenes | 2.4 | | |
| Dibenzothiophenes | 5.4 | | |
| Naphthobenzothiophenes | | 2.4 | 0.04 |
| Total | 64.4 | 35.6 | 0.60 |

A FCC main column bottoms is an excellent liquefaction solvent medium for coal solubilization because it has a unique combination of physical properties and chemical constituency. A critical aspect of solvating ability is the particular proportions of aromatic and naphthenic and paraffinic moieties characteristic of a prospective coal liquefaction solvent. A high content of aromatic and naphthenic structures in a solvent is a criterion for high solvating ability for coal liquefaction.

The solvating ability of a coal liquefaction solvent can be expressed in terms of specific types of hydrogen content as determined by proton nuclear magnetic resonance spectral analysis. Nuclear magnetic resonance characterization of heavy hydrocarbon oils is well developed. The spectra (60μ c/sec) are divided into four bonds ($H_\alpha$, $H_\beta$, $H_\gamma$ and $H_{Ar}$) according to the following frequencies in Hertz (Hz) and chemical shift (δ):

| | $H_\alpha$ | $H_\beta$ | $H_\gamma$ | $H_{Ar}$ |
|---|---|---|---|---|
| Hz | 0–60 | 60–100 | 120–200 | 360–560 |
| δ | 0–1.0 | 1.0–1.8 | 2.0–3.3 | 6.0–9.2 |

The $H_{Ar}$ protons are attached to aromatic rings and are a measiure of aromaticity of a solvent. $H_\alpha$ protons are attached to non-aromatic carbon atoms attached directly to an aromatic ring structure, e.g., alkyl groups and naphthenic ring structures. $H_\beta$ protons are attached to carbon atoms which are in a second position away from an aromatic ring, and $H_\gamma$ protons are attached to carbon atoms which are in a third position or more away from an aromatic ring structure.

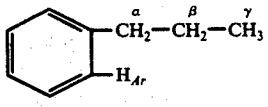

The $H_{Ar}$ protons are important because of their strong solvency power. A high content of $H_\alpha$ protons is particularly significant in a liquefaction solvent, because $H_\alpha$ protons are labile and potential hydrogen donors in a coal liquefaction process. $H_\beta$ and $H_\gamma$ protons are paraffinic in nature and do not contribute to the solvating ability of a coal liquefaction solvent.

It is particularly preferred that the FCC main column bottoms employed as a coal liquefaction solvent in the present invention process has a hydrogen content distribution in which the $H_{Ar}$ proton content is between about 30 and 50 percent, the $H_\alpha$ proton content is at least about 30 percent, and the $H_\alpha/H_\beta$ proton ratio is above about 1.4. Concomitantly it is desirable that the $H_\beta$ proton content is below 20 percent and the $H_\beta$ proton content is below 13 percent.

By the term "solvent-refined" coal is meant any of the purified carbonaceous materials produced by liquefaction of coal in a highly aromatic or partially hydrogenated aromatic solvent (e.g., tetralin, anthracene, recycle coal oil, and the like). When required, a solvent-rich liquefaction phase is separated from ash and other undissolved solids, and distillation of the liquefaction phase to remove the excess solvent and volatile components of the solution may be practiced. Recovery of the high boiling distillation residuum as "solvent-refined" coal is desired.

In a typical process, solvent-refined coal is produced by (1) heating a mixture of powdered coal and recycle coal solvent (e.g., a distillation fraction recovered in a coal liquefaction process) at a temperature of about 790° F under a hydrogen pressure of about 1000–2000 psi for a period of about 1 hour; (2) separating the liquefaction phase from solids by filtration; (3) distilling the liquefaction phase to remove the volatile components which have a boiling point below about 600° F at a standard pressure; and (4) recovering solvent-refined coal which is substantially free of ash and has a much lower oxygen and sulfur content than the original coal starting material. The solvent-refined coal is about 50 percent soluble in benzene (insoluble in pentane) and about 50 percent soluble in pyridine (insoluble in benzene). Table I summarizes the physical and chemical characteristics of West Kentucky and Illinois types of coal, and the solvent-refined coal products derived therefrom in accordance with hereinabove described liquefaction process.

The type of solvent-refined coal described in Table I contains about 50 percent by weight of asphaltene components. Table II summarizes the results of a chromatographic separation of solvent-refined coal components. The asphaltenes appear to be a mixture of polar hydrocarbons, indoles and benzofuran derivatives, each of which is substituted with phenyl and/or naphthyl groups. Solvent-refined coal is susceptible to spontaneous combustion because of the presence of asphaltene components.

TABLE I

| | West Kentucky 14 Coal | | | Illinois #6 Coal | | |
|---|---|---|---|---|---|---|
| | Dry | Dry Ash Free | SRC Product | Dry | Dry Ash Free | SPC Product |
| C | 72.98 | 79.0 | 87.6 | 70.22 | 79.4 | 85.3 |
| H | 5.12 | 5.9 | 4.8 | 4.75 | 5.4 | 5.6 |
| N | 1.33 | 1.4 | 2.0 | 1.42 | 1.6 | 1.8 |
| S | 3.06 | 3.3 | 0.8 | 3.22 | 3.6 | 0.9 |
| Ash | 8.48 | — | 0.7 | 11.57 | — | 1.5 |
| O | 9.03 | 9.8 | 3.4 | 8.82 | 9.9 | 4.3 |
| Coal $C_{100}H_{89}N_{1.5}S_{1.5}O_9$ | | | | Coal $C_{100}H_{89}N_{1.5}S_{1.5}O_9$ | | |
| SRC $C_{100}H_{66}N_{1.9}S_{0.3}O_{2.9}$ | | | | SRC $C_{100}H_{78}N_{1.8}S_{0.4}O_{3.8}$ | | |
| 7800 SCF $H_2$/ton coal | | | | Yield SRC 55% | | |
| 8.5 atoms H/100 C | | | | | | |

TABLE II

FRACTIONS OBTAINED BY LIQUID CHROMATOGRAPHY ON SILICA GEL OF W. KENTUCKY 14 SOLVENT REFINED COAL

| | Oil-like Compounds | | Asphaltenes(1) | | | Multifunctional Compounds(2) | | | |
|---|---|---|---|---|---|---|---|---|---|
| Fraction | #1 | #2 | #3 | #4 | #5 | #6 | #7 | #8 | #9 |
| Eluent | hexane | hexane 15% benzene | $CHCl_3$ | $CHCl_3$ 4% $Et_2O$ | $Et_2O$ 3% EtOH | MeOH | $CHCl_3$ 3% EtOH | THF 3% EtOH | Pyridine 3% EtOH |
| % in SRC(3) | 0.4 | 15 | 30 | 10.2 | 10.1 | 4.1 | 6.4 | 10.2 | 8.5 |

(1)Asphaltenes defined as benzene-soluble, pentane-insoluble compounds.
(2)Multifunctional products defined as pyridine-soluble, benzene-insoluble compounds.
(3)This analysis totals 94.9%; 5.1% of the SRC was not eluted from the column.

The term "solvent-refined" coal is meant to include H-coal products which are produced by liquefaction of coal in the presence of a catalyst and a solvent under hydrogen pressure at a temperature between about 650° F and 750° F. Suitable catalysts include those containing metals such as molybdenum, zinc, magnesium, tungsten, iron, nickel, chromium, vanadium, palladium, platinum, and the like. High temperature, sulfur-resistant catalysts such as molybdenum and tungsten sulfide are preferred.

In the present invention process for producing asphalt cement, the slurry is heated for a reaction time sufficient to yield a pitch-like composition which upon cooling to ambient temperatues remains homogeneous and has a flowable consistency. The heating step of the invention process is conducted for a period of time between 0.2 and 2 hours, and preferably for a period of time between about 0.5 and 1.5 hours. Although it is not essential, the liquefaction reaction can be conducted under pressure and/or in the presence of a reducing gas.

The petroleum solvent component in the liequfaction reaction mixture is provided in a quantity between about 0.5 and 10 parts by weight per part by weight of the comminuted coal component. Normally, the preferred ratio will be in the range between about 1.0 and 5 parts by weight of petroleum solvent per part by weight of coal.

The hardness number of the asphalt cement product of the process varies directly with the content of the asphaltene in the product. Hence, the hardness number and the viscosity of the final asphalt cement product increase as the proportion of the solvent-refined coal starting material component increases and the proportion of petroleum solvent component decreases.

The following examples are further illustrative of the present invention. The reactants and other specific ingredients are presented as being typical, and various modifications can be derived in view of the foregoing disclosure within the scope of the invention.

EXAMPLE I

Preparation Of Solvent-Refined Coal

Coal from crushers (−⅛ in.) is slurried with anthracene-oil-type solvent and 30 to b 40 pounds of hydrogen per ton of coal. The slurry is heated and passed to a high-pressure flash vessel at a temperature such than the liquid is filterable. The vapor stream from this stage is processed through a series of flash vessels at successively lower pressure and temperature to separate various fractions for hydrogen recycling, phenol and cresylic acid recovery, and acid gas removal.

The liquid portion of the dissolver effluent is flashed to the filter pressure and passed to precoated rotary filters for the removal of the mineral residue, which includes nearly all of the ash, all of the pyritic and half of the organic sulfur in the coal, bringing the S below 1% for most American coals. The residue is solvent-washed and stored for use as a fuel. Gas from the filter is removed and combined with the condensate from the vapor removed from the dissolver effluent, for treatment.

The liquid filtrate is heated and flashed in a vacuum vessel. The liquid residue from this stage can be used either in liquid form as a fuel or solidified to form the final fuel product.

The condensate from the vapors removed by the vacuum flash stage passes through two fractionators to recover various product. The first separates coal solvent from the wash solvent for the mineral residues and light oil products; the second separates wash wolvent from the light ends. Vapors from this process are conventionally recovered for processing in an acid gas removal plant, while the final liquid yields phenols, cresylic acid, and light oil.

EXAMPLE II

Solvent-refined final fuel product, derived in accordance with the procedure of Example I, was admixed with FCC syntower bottoms in a wt/wt ratio of 1/1 to form a slurry.

The slurry was heated at a temperature of 450° F for a period of ½ hour, and the resultant homogeneous asphalt cement product was recovered.

The same procedure was repeated with different proportions of solvent-refined coal and FCC syntower bottoms to produce asphalt cements of different hardnesses and viscosities.

The procedure was repeated with different proportions of solvent-refined coal and FCC clarified slurry oil.

The properties of the asphalt cements produced are summarized in Table III for comparison purposes. It is to be noted that the solvent-refined coal starting material had an 80 weight percent content of asphaltene components and that the hardness of the asphalt cements increased as the quantity of solvent-refined coal asphaltenes in the compositions increased. In a graph plot of penetration versus solvent-refined coal content of the asphalt cements, the log penetration is a linear function of solvent-refined coat content, irrespective of viscosity.

The asphalt cements produced in accordance with the present invention are fully equivalent to petroleum-derived asphalt cements on the basis of ASTM specifications.

TABLE III

Properties of SRC/FCC-Bottoms Asphalt Cements

| Petroleum Solvent | SRC/Oil (Wt/Wt) | Wt %[1] Asphaltenes | Product Quality | | Tests on Residue From Thin Film Over Test | |
|---|---|---|---|---|---|---|
| | | | Penetration[2] | Viscosity[3] | Viscosity[3] | Loss, Wt % |
| FCC Main Column Bottoms | 1/4 | 16 | 130 | — | — | — |
| " | 1/3 | 20 | 72 | 982.1 | 1250[4] | 1.25 |
| " | 3/8 | 22 | 60 | — | — | — |
| " | 1/2 | 27 | 33 | — | — | — |
| " | 1/1 | 40 | 3 | — | — | — |
| FCC Clarified Slurry Oil | 1/3 | 20 | 126 | 175.9 | — | — |
| " | 1/2 | 27 | 31 | — | — | — |
| " | 1/1 | 40 | 3 | — | — | — |

[1]SRC, containing about 80 wt % asphaltenes.
[2]100 g, 5 sec. ASTM D-5.
[3]140° F, poise, ASTM D-2171, repeatability ±7%, reproducibility ±10%.

EXAMPLE III 200.25g High volatile "A" bituminous coal (20–60 mesh) was mixed with 439.76g FCC main-column bottoms in an atmospheric reaction vessel fitted with stirrer and take-off condenser. The stirred mixture was brought to 750° F and held at this temperature for 1 hour. 150.50g light oil, 6cc water, and 12.5 l gas evolve during this time. The resultant product contains about 39 wt. % maf. coal. It was diluted to 19 wt. % maf. coal with and 850° F+cut of FCC main-column bottoms.

| The properties of the resultant product are: | |
|---|---|
| Softening Pt, ° F Ring & Boll | 121 |
| Conradson Carbon, % | 29.4 |
| Viscosity, 140° F, poise | 1208 |
| Penetration, 100g, 5 sec | 110 |
| Elemental Analyses, % | |
| C | 89.39 |
| H | 6.69 |
| O | 1.1 |
| High Volatile A | |
| Sulfur | 1.33% |
| Nitrogen | 1.63 |
| Oxygen | 7.79 |
| Carbon | 80.88 |
| Hydrogen | 5.33 |

-continued

| | |
|---|---|
| Ash | 2.77 |

What is claimed is:

1. A process for producing asphalt cement which comprises (1) forming a slurry by admixing solvent-refined coal with a fluidized catalytic cracking main column bottoms petroleum solvent in admixture quantities between about 1.0 and 5 parts by weight of petroleum solvent per part by weight of solent-refined coal, wherein said petroleum solvent has a hydrogen content distribution in which the $H_{ar}$ proton content is between about 30 and 50 percent, the $H_a$ proton content is at least about 30 percent, and the $H_a/H_\beta$ proton ratio is above about 1.4; and (2) heating said slurry at a temperature between about 350+ F and 850° F for a period of time between about 0.2 and 2 hours to convert the slurry into a homogeneous composition which has a flowable asphaltic consistency at standard temperature.

2. A homogeneous ash-free asphalt cement composition produced in accordance with the process of claim 1.

* * * * *

UNITED STATES PATENT AND TRADEMARK OFFICE

CERTIFICATE OF CORRECTION

PATENT NO. : 4,052,291

DATED : October 4, 1977

INVENTOR(S) : WILTON F. ESPENSCHEID and TSOUNG-YUAN YAN

It is certified that error appears in the above-identified patent and that said Letters Patent are hereby corrected as shown below:

| | |
|---|---|
| Column 1, line 48 | "petrioleum" should be--petroleum--. |
| Column 3, line 43 | "of" should be --or--. |
| Column 4, line 63 | "measiure" should be --measure--. |
| Column 5, line 12 | After "and", add --are--. |
| Column 5, line 60 | After "at" delete --a--. |
| Column 6, line 55 | "temperatues" should be --temperatures --. |
| Column 7, line 58 | "product" should be --products--. |
| Column 7, line 60 | "wolvent" should be --solvent--. |
| Column 8, line 55 | "and" should be --an--. |
| Column 9, line 11 | "solent" should be --solvent--. |
| Column 10, line 4 | "350+ F" Should be --350°F--. |

Signed and Sealed this

*Fourteenth* Day of *February 1978*

[SEAL]

*Attest:*

RUTH C. MASON
*Attesting Officer*

LUTRELLE F. PARKER
*Acting Commissioner of Patents and Trademarks*